US005462283A

United States Patent [19]

Allen

[11] Patent Number: 5,462,283

[45] Date of Patent: Oct. 31, 1995

[54] PROJECTILE DETECTION

[75] Inventor: John Allen, Portsmouth, England

[73] Assignee: Target Marketing Limited, Douglas, United Kingdom

[21] Appl. No.: 382,041

[22] PCT Filed: Aug. 6, 1993

[86] PCT No.: PCT/GB93/01671

§ 371 Date: Feb. 10, 1995

§ 102(e) Date: Feb. 10, 1995

[87] PCT Pub. No.: WO94/04883

PCT Pub. Date: Mar. 3, 1994

[30] Foreign Application Priority Data

Aug. 11, 1992 [GB] United Kingdom ..... 921690

[51] Int. Cl.[6] ..... F41J 5/04

[52] U.S. Cl. ..... 273/371

[58] Field of Search ..... 273/371, 373, 273/376

[56] References Cited

U.S. PATENT DOCUMENTS 4,678,194 7/1987 Bowyer et al. ..... 273/373

FOREIGN PATENT DOCUMENTS

| | | | |
|---|---|---|---|
| 181420 | 5/1986 | European Pat. Off. | 273/371 |
| 2185896 | 8/1987 | United Kingdom | 273/371 |
| 2198656 | 6/1988 | United Kingdom | 273/376 |
| 8705688 | 9/1987 | WIPO | 273/371 |
| 9115729 | 10/1991 | WIPO | 273/371 |

*Primary Examiner*—Paul E. Shapiro

*Attorney, Agent, or Firm*—Ware, Fressola, Van Der Sluys & Adolphson

[57] ABSTRACT

A dart target includes a plurality of electrically conductive scoring beds. An aerial is spaced from the beds by a separation of the order of magnitude of the size of the target. A transmitter and receiver are connected to the aerial and beds. When an electrically conductive dart is imbedded in one of the beds it receives a signal from the aerial which enables determination of which bed the dart is imbedded in. The spacing of the aerial results in more or less uniform signal strength at the dart regardless of its location in the target.

20 Claims, 3 Drawing Sheets

PROJECTILE DETECTION

FIELD OF THE INVENTION

Figure 1:
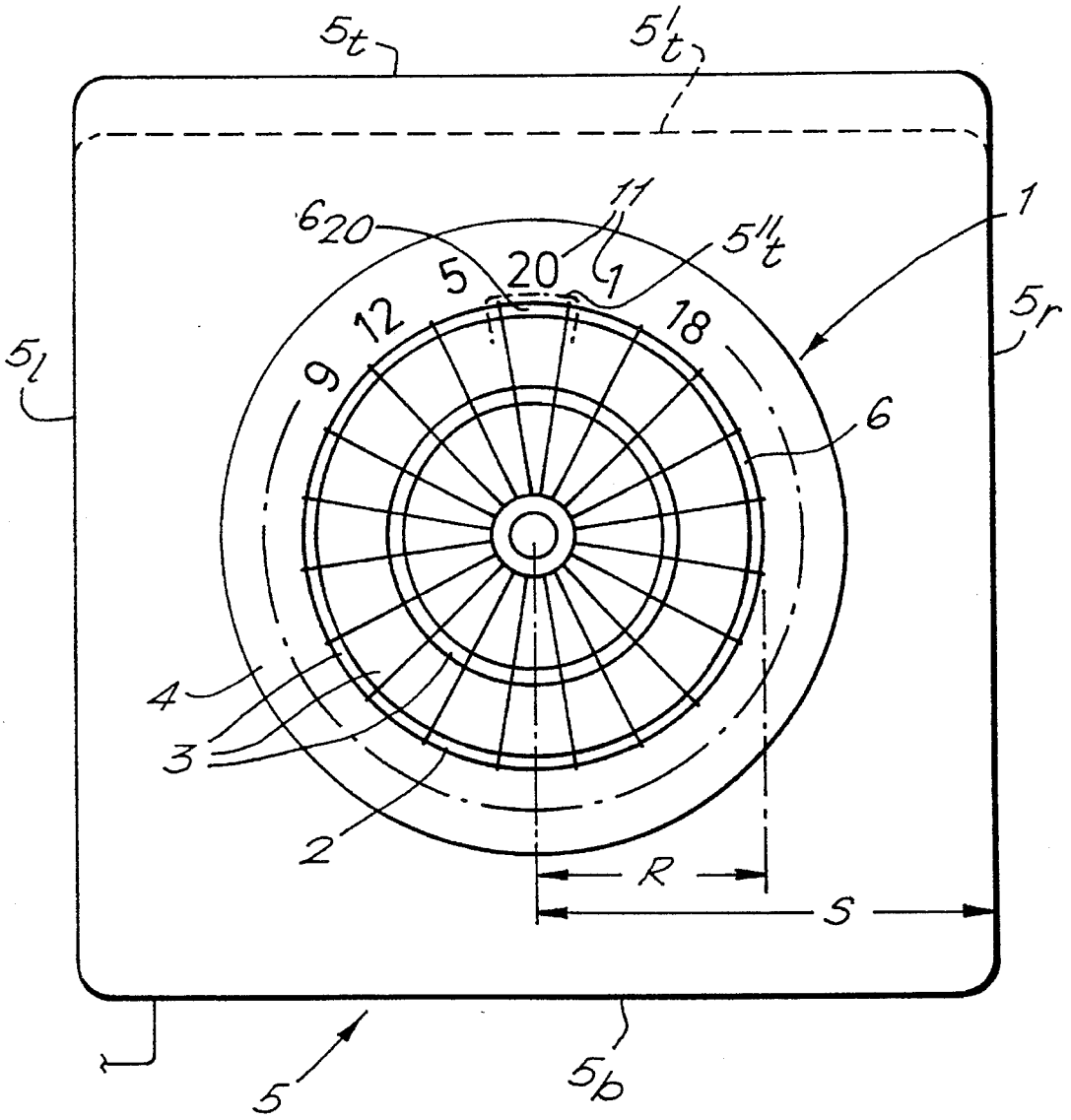

The present invention relates to detection of the position of a projectile with respect to a target, and in particular but not exclusively to detection of the position of a dart in a dart board.

BACKGROUND OF THE INVENTION

It is known to construct a dart board with each separately scoring section of the board being of electrically conductive material and being insulated from adjacent sections. In a prior detection arrangement, the sections are respectively sequentially connected to a radio transmitter and the wire grid delineating the sections is arranged as a receiving aerial. When a dart is embedded in and at the same time partially projects from one section—also known as a "dart bed"—the dart acts as an aerial and the signal received at the time appropriate to connection of that bed is received more strongly at the grid. Thus the particular bed in which the dart is partially embedded can be determined from the timing of the higher level of received signal.

This arrangement suffers from the disadvantage that the received signal can vary greatly in accordance with the position of the dart in the bed. If the dart is in the middle of the bed, the signal is comparatively small; whereas if the dart is adjacent the grid, the signal is comparatively much larger.

European Patent No. 121,550 describes and claims: "A target apparatus comprising a target adapted to have a projectile thrown at it, and an associated automatic scoring arrangement, the target being divided into a plurality of separate beds each associated with a predetermined score that can be obtained by a player or sportsman causing a projectile to hit that bed, characterised in that the target is adapted to have a projectile at least partly made of electrically conductive material partially embedded therein with part of the projectile protruding from the target, each bed incorporating electrically conductive means for applying an electrical signal which is specific to that bed to a projectile embedded .in said bed, the apparatus further including an aerial or antenna for receiving electromagnetic radiation radiating from part of a projectile protruding from a bed, and means responsive to a received signal for determining the score attributable to the projectile from which the radiation is emanating."

It has been proposed that the arrangement of the beds as transmitters and the wire grid as receiver should be reversed with the beds being receivers and the grid being the transmitter. Such a reversal does not improve the basic problem of wide variation in received signal strength with dart position.

European Patent Application No. 181,420 described: "A target apparatus comprising a target of the type into which a projectile of conductive material may be embedded with part of the projectile still protruding from the target, and an associated automatic scoring arrangement, the target being divided into a plurality of separate mutually insulated beds each associated with a predetermined score that can be obtained by a player or sportsman causing a projectile to become embedded in that bed, and an aerial or antenna transmitting electromagnetic radiation which can be received by a part of a projectile protruding from a bed, each bed incorporating electrically conductive means for leading any signal present on the bed to means for determining the score attributable to the projectile, embedded in the bed, which is receiving the radiation."

THE INVENTION

The object of the present invention is to provide an arrangement having less extreme variations in received signal strength with dart position.

According to the invention, there is provided apparatus for detecting embedding of an at least partially conductive projectile in a target and identifying its embedded position in the target, the apparatus comprising;

a target having a plurality of electrically conductive beds mutually insulated from each other and each having an identity, means for determining the identity of any one of the beds having an at least partially conductive projectile embedded in and partially protruding from it, an aerial associated with the target, transmitting and receiving equipment connected to the beds and the aerial;

characterised in that the aerial is peripherally spaced from the beds.

According to another aspect of the the invention, there is provided apparatus for detecting embedding of an at least partially conductive projectile in a target and identifying its embedded position in the target, the apparatus comprising;

a target having a plurality of electrically conductive beds mutually insulated from each other and each having an identity, means for determining the identity of any one of the beds having an at least partially conductive projectile embedded in and partially protruding from it, an aerial associated with the target, transmitting and receiving equipment connected to the beds and the aerial;

characterised in that the aerial is spaced from the beds by a separation of the order of magnitude of the size of the target.

Normally each identifiable, electrically-conductive bed will be associated with a particular score in a game played with the apparatus. However the apparatus may be arranged for playing of games in which the identity alone and not a score associated with the bed is significant. Further, it is conceivable that the apparatus may be employed for purposes other than the playing of games.

By arranging the aerial to be peripherally separated from the target, the difference in separation of the projectile, typically a dart, from the aerial between extreme positions possible in the individual sections, typically dart beds, is small compared with the mean separation from the target. Thus the difference in received signal strength with differing dart position in a bed is small.

By contrast, in the prior art arrangements referred to above, the aerial was the dart board wire delimiting the beds themselves. Thus the dart could be extremely close to the wire, the aerial, or in the middle of the bed, giving large differences in received signal with differing dart position in the bed. This could give rise to difficulty in determining in which bed the aerial was embedded.

Apparatus of the invention can be constructed to have a worst case of received signal variation with projectile embedded position in a particular bed of 1.8:1; whereas the prior apparatus could have a comparable signal variation of 100:1.

Whilst the apparatus can be arranged with the individual dart beds being transmitting aerials, in the preferred embodiment, the individual dart beds are connected to the receiving side of the equipment and the peripheral aerial is the transmitting aerial.

Preferably the peripheral aerial is arranged symmetrically with respect to the target. It may extend on two sides only of the target, but preferably extends circumferentially around the target.

The ideal aerial is circular and of twice the diameter of the dart board wire. In order to avoid being struck by the darts, it cannot be in front of the dart head, unless of a larger diameter than that of the non-scoring bed or at the minimum the dart board wire. If the aerial is placed behind the dart head, means is preferably provided behind the dart head for absorbing electromagnetic radiation direct from the aerial to connections from the individual beds to the receiving equipment. Indeed even in the preferred arrangement of the aerial and the dart head being generally co-planar, means is preferably provided for absorbing this radiation.

To enable the target to be rotated to compensate for excessive wear at any one relative position, i.e. bed, of the target and for target detection logic to sense the orientation of the target, one element of the aerial can be arranged closer to the target than the other elements thereof. The quiescent signal received in the dart bed nearest the one element will be the strongest signal and target detection logic of the apparatus will be able to determine that this bed is nearest to the one aerial element. Alternatively, a separate, auxiliary aerial may be arranged so as to cause transmission from it to a particular one of the beds to be most strongly received in the one bed so as to identify that particular bed.

In a further alternative, the orientation of the target can be determined by adaption of the target detection logic to memorise any particular bed as having a pre-determined identity—and other beds as having identities in accordance with a predetermined pattern—on setting of the logic to a "board orientation mode" and inserting a projectile or dummy projectile into the particular bed. Conveniently, the particular bed is the twenty scoring bed and the pattern of identities is in accordance with the conventional dart board score pattern.

Particularly in the case of a dart board, the non-scoring surrounding bed, that is the circumferential area outside the double scoring beds, is preferably electrically grounded. This has the effect of attenuating all received signals, in particularly the received noise. Further the wire grid delimiting the differently scoring beds is also preferably grounded to further attenuate received signals including noise.

In the preferred embodiment, the target detection logic of the apparatus is adapted to detect the following:

1) falling out of a projectile temporarily embedded in one of the beds, in which case the score of the fallen out projectile is ignored;
2) manual insertion and/or removal of a projectile in and/or from one of the beds of the target;
3) close approach of a paramagnetic object—typically part of the human body—to the target;
4) use of the target in having projectiles thrown at it and to sound an alarm when the apparatus is set to score the use and payment has not been received;
5) instructions from a control panel for:
   i) correcting the score display in the event of a score being incorrectly detected and/or
   ii) selecting a level of skill for a game in which a player plays against the apparatus.

THE DRAWINGS

Figure 2:
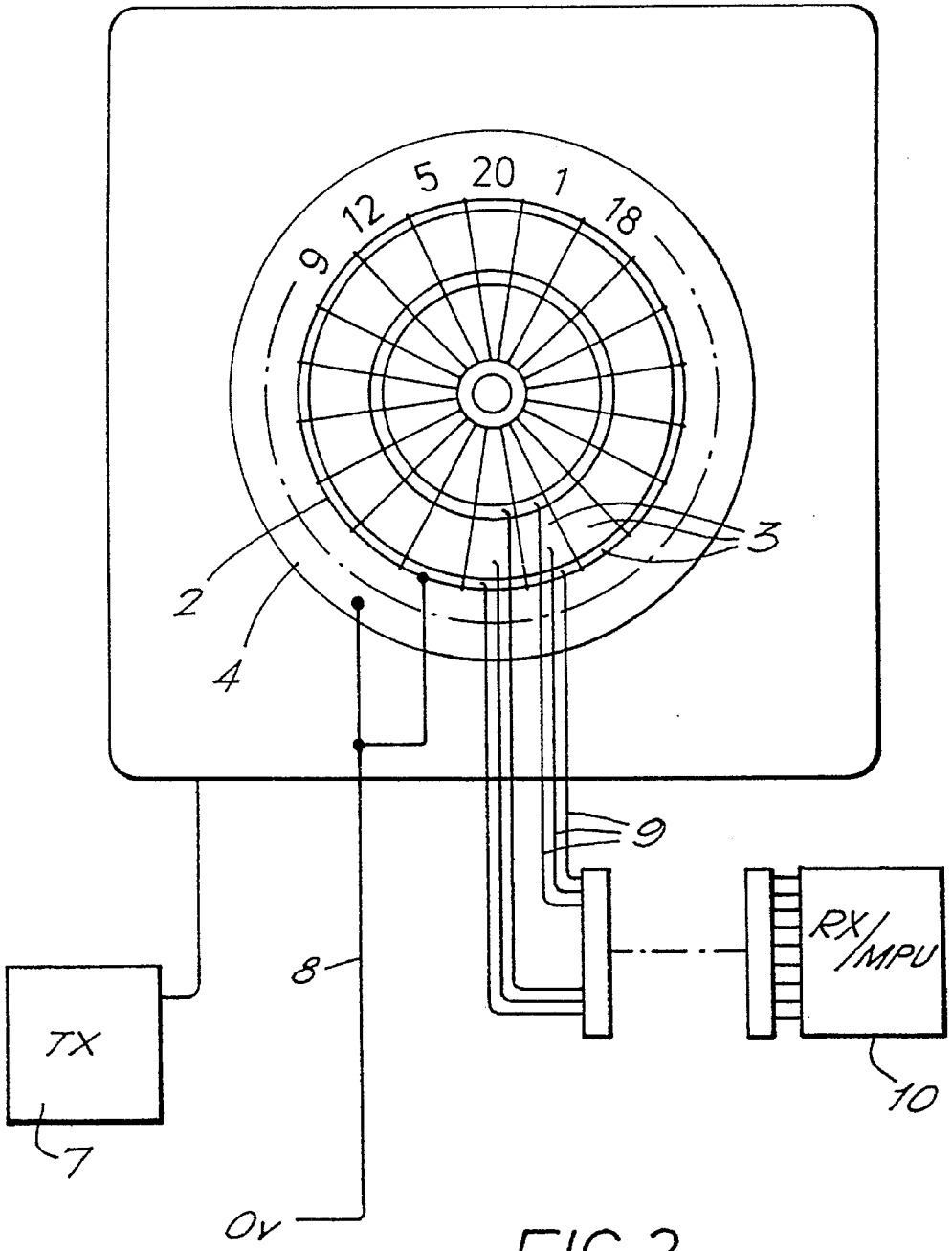
Figure 3:
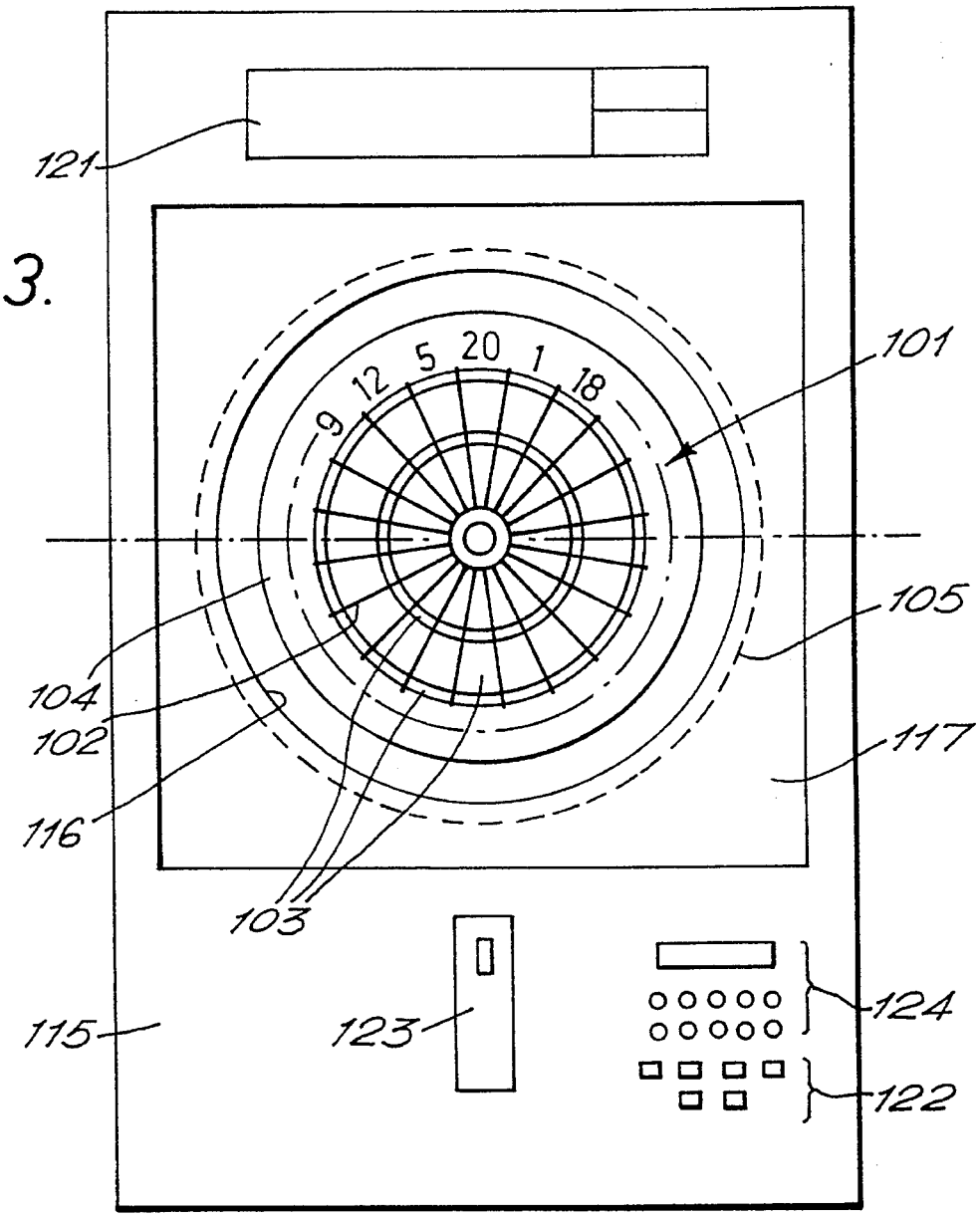
Figure 4:
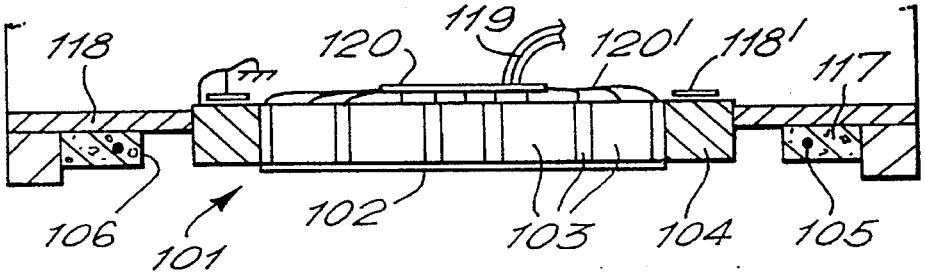

To help understanding of the present invention, a specific embodiment thereof will now be described with reference to the accompanying drawings, in which:

FIG. 1 is diagrammatic front view of an apparatus for detecting the position of a dart embedded in a dart board, FIG. 2 is a schematic circuit diagram of the apparatus of FIG. 1, FIG. 3 is a view similar to FIG. 1 of a second embodiment of apparatus of according to the invention FIG. 4 is a cross-sectional view on the line IV—IV in FIG. 3.

FIRST EMBODIMENT OF THE INVENTION

Referring first to FIG. 1 of the drawings, the dart board, also known and referred to in this description as a "dart head", 1 has a metal grid 2 visually delimiting the separate scoring sections 3, i.e. darts beds, of the dart head. The dart beds 3 are insulated from each other by conventional means and are of electrically conductive material. The dart beds are surrounded by a non-scoring bed 4. Spaced from the dart head and mounted in a non-shown frame work in which the dart head is supported is a generally square aerial 5. The aerial has left, right, top and bottom elements $\mathbf{5}_1$, $\mathbf{5}_r$, $\mathbf{5}_t$, $\mathbf{5}_b$. Each is perpendicularly separated from the centre of the dart head by a separation S equal to the outside radius R of the double scoring beds 6. Alternatively, the aerial 5 could be circular of the same radius R. This is the optimum aerial size.

As shown in FIG. 2, the aerial 5 is connected to a low power transmitter 7, typically transmitting at 125 kHz. The grid 2 and the non-scoring bed 4 are grounded by a common line 8, whereby not only the transmitted radio waves at the scoring beds 3, but also all the ambient noise at the beds is considerably attenuated. The level of transmission can be controlled, consistent with not interfering with other equipment, whereby the arrangement provides an adequate signal to noise ratio at the scoring beds. In practice, 90% of the strength all received signals are absorbed. For a desired peak to peak received signal strength of 5 volts, 50 volts are applied to the aerial.

All sixty two scoring beds 3 are connected by their own lines 9 to a multiplexed receiver incorporated with a microprocessor unit 10, to enable them to be individually identified.

In use, a dart is thrown at the dart head and lodges in one of the scoring beds 3. It acts as a receiving aerial increasing the signal level at the bed in question. When the unit 10 measures the level of signal received at this bed and compares it with the level received on the previous measurement for this bed, an increased signal will be measured. It should be noted that a slightly increased signal will be measured at adjacent beds. The logic of the unit enables it to identify in which bed the dart is lodged. The arrangement is effective to allow a further increase in signal to be measured should a second and indeed a third dart be lodged in the same dart bed.

The single scoring beds are long and thin. Thus if the transmitting aerial were close to them, as is the case in the prior art, wide variations in the received signal would be apparent according to where along the length of the bed the dart is lodged. However, in accordance with the invention, the separation of the dart from the nearest aerial section is such that the received signal strength wherever the dart is in the bed remains sufficiently constant for ready unambiguous bed identification by the unit 10.

Because certain beds are higher scoring, such as the double twenty bed $6_{20}$, it is desirable to be able to rotate the entire dart head—whilst repositioning the score numbers 11. If as optionally shown by a dashed line $5_t$, the top aerial section is closer to the top of the dart head than the other aerial sections, in quiescent conditions without any darts in the dart head, the double twenty bed $6_{20}$ will give a larger received signal than any of the other double scoring beds. The logic can then identify this bed as the double twenty bed.

Alternatively, a separate, auxiliary aerial $5_t''$ positioned and shaped to encompass part of the double twenty bed so as to cause transmission from it to the bed to be most strongly received in the bed, may be used to identify the particular bed presently associated with the double twenty score.

SECOND EMBODIMENT OF THE INVENTION

Turning now to FIGS. 3 and 4, a second configuration of dart head 101 and aerial 105 are there shown. The dart head is in fact identical to that of FIG. 1. Its wire grid 102 and conductive beds 103 can be seen in FIG. 4. It has a conventional dart head scoring bed and wire grid diameter of 340 mm (13⅜"), with a 60 mm non-scoring circumferential bed 104, giving an overall of 460 mm (18"). The dart head is arranged in a casing 115 at an aperture 116, with a 540 mm internal diameter, in a plastics foam block 117. The dart head and the foam block are mounted in a backing board 118 supported in the casing. The aerial 105 is circular and is buried in the foam 20 mm from the edge of the aperture 116. Thus the aerial has a diameter of 580 mm compared with the 340 mm overall diameter of the scoring beds 103 of the dart head. The transmitting and reception equipment and the microprocessor unit, and its programming for identifying the individual beds and associating a score with them in accordance with their conventional darts game score or in accordance with any other game, for this embodiment are identical with those for the first embodiment. They are not shown in FIGS. 3 & 4 and will not be described.

For varying the actual bed presently acting as the double twenty scoring bed, the dart head is mounted to be rotatably adjustable in the backing board 118, by a little short of 360° to preserve integrity of electrical connections 119 from a circuit board 120 directly mounted on the dart head to other circuit boards mounted in the casing but not shown. The electrically conductive, scoring beds 103 of the dart head are individually, directly electrically connected to the circuit board 120 by wires 120'. Where the backing board is metallic and grounded, negligible signal can reach the wires 120' direct from the aerial 105. Where the backing board is wooden, a grounded metal strap 118' is provided (partly for securing the dart head and) for absorbing the signal from the aerial which would otherwise directly reach wires 120.

In this embodiment, orientation of the target can be determined by means of the apparatus's logic as described above before the description of the drawings.

The adaptions of the target detection logic of the apparatus mentioned above will now be expanded on. The actual software details necessary will be within the capabilities of the man skilled in the art and will not be separately described.

1) Falling out of a projectile temporarily embedded in one of the beds. Detection of this is achieved by the cessation of the detection of the presence of a dart previously detected before the end of a throw of three darts.

2) Manual insertion and/or removal of a projectile in and/or from one of the beds of the target. Manual insertion will result in a much larger than usual signal being received, since the player's hand and body will greatly increase the aerial capacity of the dart being inserted or removed before the end of the throw. Thus such a large signal is detected and used to cause the score panel 121 to be set to zero and one of a number of illuminated control buttons 122 to be illuminated to indicate that the particular player's throw is over or finished. Manual removal will normally be detected after a player's throw of three darts, but such will be ignored as nothing un-expected.

3) Close approach of a paramagnetic object—typically part of the human body—to the target. Close approach will cause a general decrease in the level of quiescent signal received at the individual beds of the dart head due to absorption of the electromagnetic radiation from the transmitting aerial. The decrease in received signal is used to sound an alarm, typically the playing of synthetic music from non-shown speakers.

4) Use of the target in having projectiles thrown at it and to sound an alarm when the apparatus is set to score the use only when payment is made via a coin acceptor 123 and payment has not been received. Non-paid-for play is detected in the normal manner, except that no score is displayed. Its detection is used to sound the music alarm.

5) Instructions from a control and subsidiary display panel 124 for:

i) correcting the score display in the event of a score being incorrectly detected and/or ii) selecting a level of skill for a game in which a player plays against the apparatus.

These are techniques requiring no further description for their implementation by the man skilled in the art.

I claim:

1. Apparatus for detecting embedding of an at least partially conductive projectile in a target and identifying its embedded position in the target, the apparatus comprising;

a target having a plurality of electrically conductive beds mutually insulated from each other and each having an identity, means for determining the identity of any one of the beds having an at least partially conductive projectile embedded in and partially protruding from it, an aerial associated with the target, transmitting and receiving equipment connected to the beds and the aerial;

characterized in that the aerial is spaced from the beds by a separation of the order of magnitude of the size of the target.

2. Apparatus according to claim 1, including a non-scoring, circumferential bed of the target, the aerial being spaced outwardly of the non-scoring, circumferential bed of the target.

3. Apparatus according to claim 1, wherein the aerial and the dart head are generally co-planar.

4. Apparatus according to claim 1, wherein means is provided for absorbing electromagnetic radiation direct from/to the aerial to/from connections from the individual beds to the receiving/transmitting equipment.

5. Apparatus according to claim 1, wherein the aerial is the transmitting aerial of the transmitting and receiving equipment.

6. Apparatus according to claim 1, the peripheral aerial is arranged symmetrically with respect to the target.

7. Apparatus according to claim 6, wherein the aerial extends on two sides only of the target.

8. Apparatus according to claim 7, wherein the aerial extends circumferentially around the target.

9. Apparatus according to claim 1, wherein, for determining the orientation of the target, the aerial has one element which is arranged closer to the target than the other element(s) thereof, whereby a quiescent signal received in the bed nearest the one element will be the strongest signal and target detection logic of the apparatus will be able to determine that this bed is nearest to the one aerial element.

10. Apparatus according to claim 1, wherein a separate, auxiliary aerial arranged so as to cause transmission from it to a particular one of the beds to be most strongly received in the bed is provided to identify that particular bed.

11. Apparatus according to claim 1, wherein, for determining the orientation of the target, target detection logic of the apparatus is adapted to memorize any particular bed as having a pre-determined identity—and other beds as having identities in accordance with a predetermined pattern—on setting of the logic to a "board orientation mode" and inserting a projectile or dummy projectile into the particular bed.

12. Apparatus according to claim 1, wherein the target has a non-scoring circumferential bed which is electrically grounded.

13. Apparatus according to claim 1, wherein the target has a wire grid delimiting the differently scoring beds, the wire grid being electrically grounded.

14. Apparatus according to claim 1, wherein target detection logic of the apparatus is adapted to detect falling out of a projectile temporarily embedded in one of the beds.

15. Apparatus as claimed in claim 14, wherein the bed identifying means is adapted and arranged to associate a respective score with each bed and wherein the target detection logic is further adapted to ignore the score of the fallen out projectile.

16. Apparatus according to claim 1, wherein the bed identifying means is adapted and arranged to associate a respective score with each bed.

17. Apparatus according to claim 1, wherein target detection logic of the apparatus is adapted to detect manual insertion and/or removal of a projectile in and/or from one of the beds of the target.

18. Apparatus according to claim 1, wherein target detection logic of the apparatus is adapted to detect close approach of a paramagnetic object to the target.

19. Apparatus according to claim 1, wherein:

the bed identifying means is adapted and arranged to associate a respective score with each bed, the target detection logic is further adapted to ignore the score of the fallen out projectile, it includes a payment acceptor and an audio alarm and target detection logic of the apparatus is adapted to detect use of the target in having projectiles thrown at it and to sound an alarm when the apparatus is set to score the use and payment has not been received.

20. Apparatus according to claim 1, wherein the bed identifying means is adapted and arranged to associate a respective score with each bed wherein it includes a control panel and a score display and wherein target detection logic of the apparatus is adapted to accept instructions from the control panel for:

i) correcting the score display in the event of a score being incorrectly detected and/or ii) selecting a level of skill for a game in which a player plays against the apparatus.

* * * * *